US006148931A

United States Patent [19]

Nyber et al.

[11] Patent Number: 6,148,931

[45] **Date of Patent: *Nov. 21, 2000**

[54] MOTOR-DRIVEN HAND TOOL

[75] Inventors: Oliver Nyber; Walter Penka, both of Nürtingen, Germany

[73] Assignee: Metabowerke GmbH & Co., Nurtingen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/797,603

[22] Filed: Feb. 7, 1997

[30] Foreign Application Priority Data

Feb. 22, 1996 [DE] Germany ..... 196 06 5356

[51] Int. Cl.[7] ..... B24B 23/02

[52] U.S. Cl. ..... 173/170; 16/116 R; 451/357

[58] Field of Search ..... 173/162.1, 162.2, 173/210, 211, 170, 171; 451/357; 16/116 R; 227/10

[56] References Cited

U.S. PATENT DOCUMENTS

| | | | |
|---|---|---|---|
| 1,809,060 | 6/1931 | Nelson et al. . | |
| 2,499,962 | 3/1950 | Mandl et al. | 29/76 |
| 2,639,564 | 5/1953 | Atkin | 51/170 |
| 2,831,463 | 4/1958 | Ekstrom et al. . | |
| 3,849,943 | 11/1974 | Thomas et al. | 451/357 |
| 4,371,043 | 2/1983 | Kubokawa | 173/162.2 |
| 5,049,012 | 9/1991 | Cavedo . | |
| 5,074,081 | 12/1991 | Beth et al. . | |
| 5,466,183 | 11/1995 | Kirn et al. | 451/357 |
| 5,558,570 | 9/1996 | Nakamura et al. | 451/357 |
| 5,732,869 | 3/1998 | Hirtl | 227/10 |

FOREIGN PATENT DOCUMENTS

| | | |
|---|---|---|
| 0249037A2 | 12/1987 | European Pat. Off. . |
| 2695054 | 3/1994 | France . |
| 3901728A1 | 7/1990 | Germany . |
| 4132058A1 | 4/1993 | Germany . |
| 4203171C1 | 6/1993 | Germany . |
| 9304887 | 9/1993 | Germany . |
| 3829801C2 | 1/1995 | Germany . |
| 19508035A1 | 10/1995 | Germany . |
| WO 93/21751 | 11/1993 | WIPO . |

*Primary Examiner*—Scott A. Smith
*Attorney, Agent, or Firm*—Jones, Tullar & Cooper PC

[57] ABSTRACT

A motor-driven hand tool, such as an eccentric grinder, angular grinder or sander, with a removable grip; for easier handling of the tool. The tool is improved by providing the grip with a securing element, which is disposed in a manipulation region of the grip and is movable relative to the grip, in particular being rotatable, so as to manually mount or release the grip.

16 Claims, 2 Drawing Sheets

MOTOR-DRIVEN HAND TOOL

BACKGROUND OF THE INVENTION

The present invention relates to a motor-driven hand tool, such as an eccentric, angular or oscillating grinder or sander, with a removable grip. The motor-driven hand tool may involve either electric hand tools or compressor-driven hand tools. It also relates to the removable grip.

Known hand tools are often equipped with two grips, one of them often embodied as a removable additional grip. For instance, power drills are known in which an elongated, straight grip with a protruding threaded portion can be screwed into an opening in the tool housing, transversely to the direction of the drill spindle. This is inconvenient because it requires rotating the grip several times around itself, which necessitates grasping it multiple times. In another known power drill, the grip, likewise extending transversely to the drill spindle, is mounted on the tool housing via a handcuff-like fastening that is fitted over the drill chuck region of the power drill, and a wing nut is tightened or loosened manually. This grip is extremely complicated to mount and unmount, since the power drill is either held between the user's upper arm and body or between his legs, while one hand puts the grip in the desired position relative to the tool housing and the other hand is needed to tighten the aforementioned wing nut.

From German Patent DE 42 03 171 C1, a grinding device of this general type is known, whose removable additional grip can be moved in the circumferential direction, relative to the tool drive shaft, on the outside of the tool housing. The grip substantially comprises a spherical knob with a female thread, which can be screwed to a threaded bolt that protrudes out of a spherically curved receptacle that is movable in the circumferential direction. To be screwed on, the knob must be turned multiple times, which requires tedious repositioning of the hands. The grip cannot be shaped ergonomically; instead, its rotationally symmetrical design is predetermined.

OBJECT AND SUMMARY OF THE INVENTION

It is therefore an object of the present invention to provide a removable grip for a hand tool, and to improve a hand tool of the type noted, such that the grip can be mounted or removed in a simpler way, thus allowing a favorable ergonomic shaping for the tool in question. When the grip is mounted or removed, the tool and the grip should be easy to manipulate; it should be unnecessary to change hand positions, nor should any problems arise in holding or supporting the hand tool.

This object is attained in a motor-driven hand tool according to the present invention in that the grip has a securing element, disposed in the manipulation region of the grip and in particular rotatably movable, relative to the grip for the sake of manual mounting or release of the grip.

Because the securing element is provided in the manipulation region of the grip and is movable, in particular rotatably, relative to it for mounting or releasing it, repeated changing of hand positions, as has been described as disadvantageous above, can be omitted; the grip is held or positioned with one hand, and the securing element for securing or releasing the grip is actuated with the same hand, in particular being rotated with the fingers, while the grip continues to be held by the palm of the hand or stays in the palm of the hand and is supported by it.

In an advantageous embodiment of the present invention, the securing element is a screw, positionally secured in the grip, with a manually graspable and actuatable head. The head of the screw is advantageously grasped with the thumb and index finger or middle finger for the purpose and turned. However, other securing elements are conceivable, for instance in the form of a bayonet mount. Even in the case of a rotatable securing element, this element need not necessarily be embodied by a screw; it might also be some threaded part that is connectable to an actuating head and can be screwed with a threaded bolt that protrudes from the tool housing. Instead of a screw, a limited-displacement pin with annular grooves that can interlock with the tool body, or an insertable pin that can be secured by rotation and engages a stop from behind or interlocks with it could be used.

In a very particularly advantageous embodiment of the present invention, the grip has a recess, opening into its grip face, in which recess the securing element is manually actuatably provided. In a further feature of this inventive concept, the securing element protrudes from the recess past the grip face and is thereby graspable, in particular rotatable. In this preferred embodiment, the recess need not be made so large that the hand tool user's fingers can get into the recess to reach the securing element; instead, the recess may be adapted substantially to the shape of the securing element and can surround it quite closely. From the visual standpoint as well, this makes for a compact, attractive appearance of the grip. The grip may for instance take the form of an ergonomically shaped pommel, and the recess may be extended in the form of an opening from one side of the grip face of the pommel to the other. In that case, the securing element preferably protrudes from two opposed sides past the grip face of the grip.

The mounting position of the grip on the tool body is preferably predetermined. It proves to be advantageous if the grip is not unintentionally rotatable or pivotable relative to the tool body; this can preferably be attained by means of a complementary shaping of the tool body in the grip, for instance in that the radius of curvature of the side of the grip that can be placed against the tool body is embodied to correspond to the curvature of the tool body. In addition, between the grip and the tool body, ribs, lands, pins, and correspondingly embodied recesses in the other part may be provided.

Advantageously, the grip includes two half-shell parts, which can be produced in a simple way, for instance by plastic injection molding, and can preferably be interlocked with one another.

The half-shell parts define a through opening for the securing element, which element is inserted before the half-shell parts are closed and is positionally secured inside the opening by connecting the half-shell parts.

In a preferred embodiment of the present invention, the intrinsically manually actuatable securing element additionally has a tool engagement point, for instance for a screwdriver, socket wrench or the like. This can prove advantageous whenever long-term mounting of the grip on the tool body is desired, so that a manually nonreleasable mounting would be advantageous. However, for the case where the grip is to be removed and the user is not capable of manually releasing the securing element, this embodiment again proves to be expedient and advantageous. If the securing element is accommodated in a recess in the grip, then the grip may have an access opening, opening into the recess, leading to the tool engagement point of the securing element.

Further characteristics, details and advantages of the present invention will become apparent from the appended claims, the drawing, and the ensuing description of an advantageous embodiment of the present invention.

DESCRIPTION OF THE PREFERRED EMBODIMENT

Figure 1:
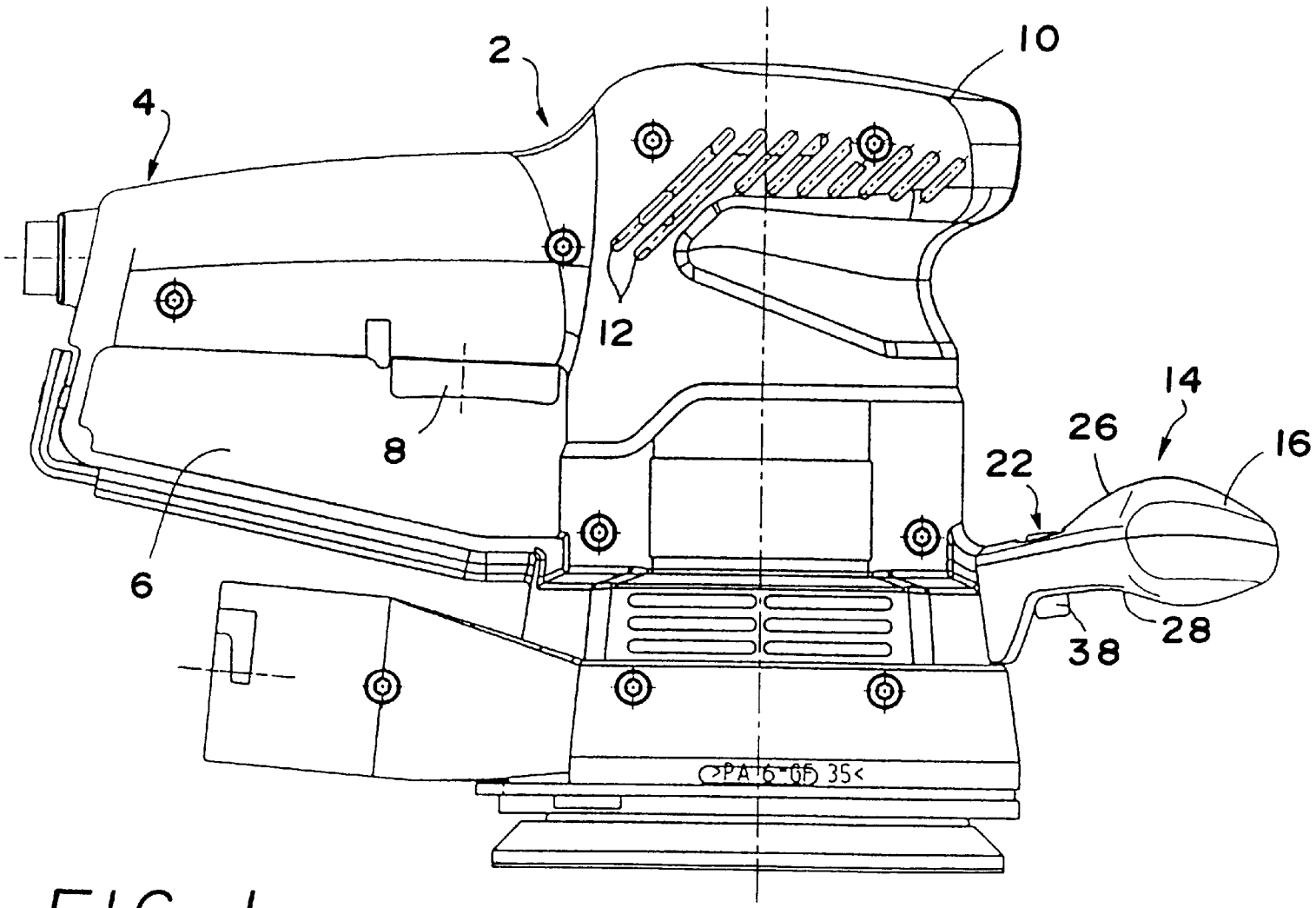
FIG. 1 is a side view of a hand tool embodied according to the present invention.

FIG. 1 shows a hand-guided eccentric grinder identified overall by reference numeral 2, with a first grip 4 solidly attached to the housing and defining a reach-through opening 6. An actuation key 8 extends into this opening 6 from the grip 4. The grip 4 is molded onto a motor housing 10, in which vent slits 12 are formed, but which can also be grasped with the hand in its upper region in order to manipulate and guide the eccentric grinder. For still better guidance of the eccentric grinder 2, an additional removable grip 14 is provided, in the vicinity of the eccentrically driven grinder head, in the lower region of the tool body. The grip 14 has an ergonomically curved pommel shape 16 and is T-shaped in plan view (FIG. 3), but without having any sharp corners or edges. The grip 14 includes two half-shell parts 18, 20 of a plastic material that can be interlocked with one another. The grip 14 can be secured to the tool body by means of a securing element 22, in the form of a screw 24, that is rotatable relative to the half-shell parts 18, 20.

Both half-shell parts 18, 20 have an opening 30, 32 or through opening in their respective grip face 26, 28, as a result of which a recess 34 is defined or uncovered inside the grip 14 for receiving and positionally securing a head 38 of the screw 24. The half-shell parts 18, 20 also define a through opening 36 for the shaft of the screw 24 which intersects the recess 34. The screw 24 is placed in one of the half-shell parts and is positionally secured by joining or locking together the two half-shell parts; and as noted, the head 38 of the screw 24 is located in the recess 34. As shown particularly clearly in FIG. 1, the screw head 38 protrudes past the grip face 26, 28 on both sides of the grip 14 and can thus easily be rotated with the thumb and index finger or middle finger, and the grip 14 can be held with the same hand without requiring tedious repositioning of the hands.

The screw head 38 has a tool engagement point 40 for a socket wrench on its face end; this point can be reached through a conduit-like access opening 44, represented by the dashed line 42.

Figure 2:
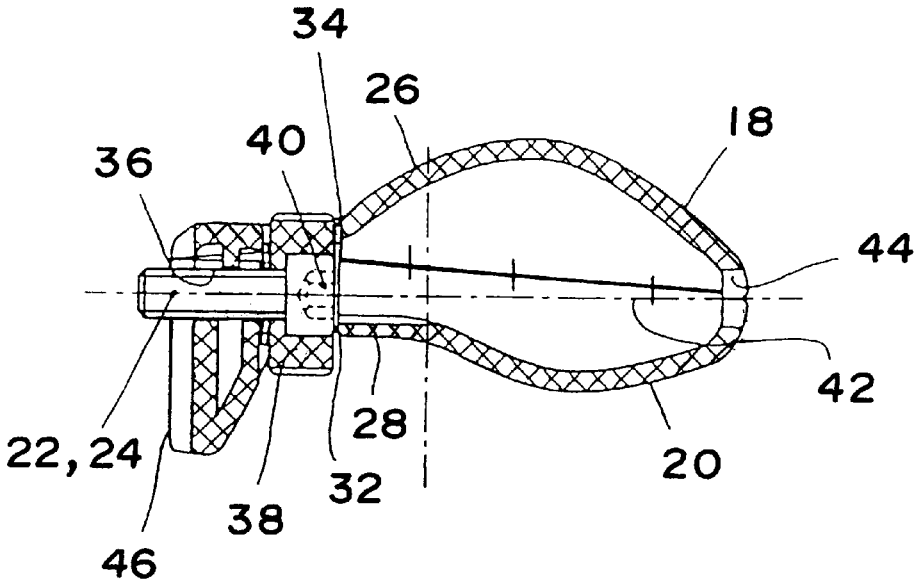
FIG. 2 is a section through a removable grip of the hand tool of the FIG. 1.
Figure 3:
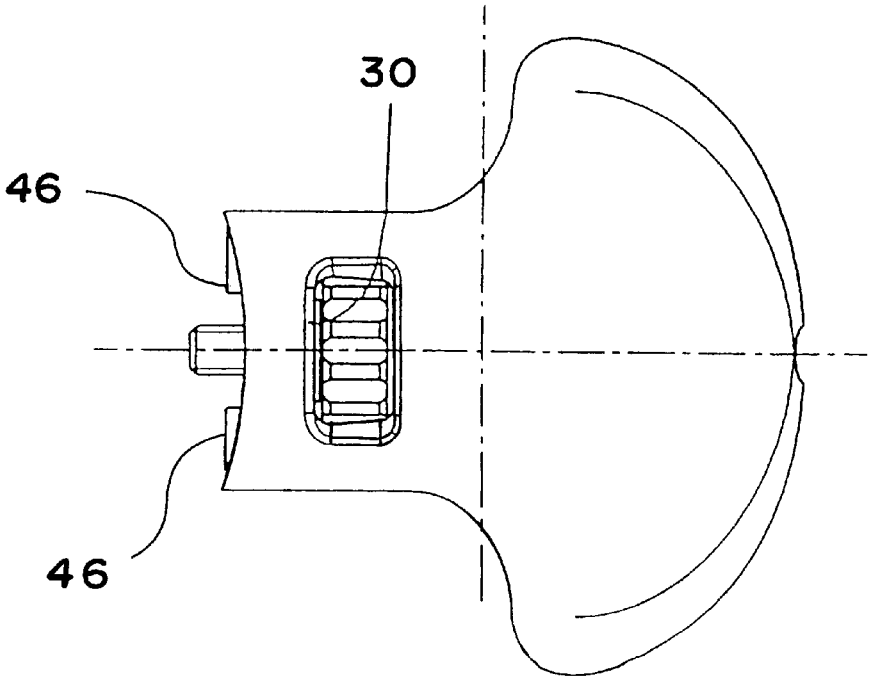
FIG. 3 is a plan view on the removable grip of the hand tool of FIG. 2.

As shown in FIGS. 2 and 3, the end of the grip 14 adjacent the opening end 36 may include ribs 46 which engages corresponding recesses (not shown) in the tool body. Engagement of the ribs in the corresponding recesses serve to better center the grip to the tool body.

What is claimed is:

1. A motor-driven hand tool held by a user, comprising:

a housing having a fixed handle;

tool means mounted to said housing;

drive means mounted to said housing and engaging said tool means for driving said tool means; and a removable grip having a securing element mounted therein, said removable grip being mounted to said housing by said securing element, said removable grip defining an outside surface, a front contacting surface an opposed rear end surface, an opening and a recess opening, which recess opening is oriented transversely to and intersecting said opening, and opens into said outside surface adjacent to said front contacting surface, in which opening and recess opening said securing element is mounted, said securing element having a housing engaging portion protruding outwardly from said front contacting surface and a part thereof protruding from said recess opening past said outside surface to be manually rotatable relative to said removable grip by a direct engagement of said part thereof with the user's hand, thereby mounting and releasing said removable grip from said motor-driven hand tool.

2. The motor-driven hand tool held by a user as defined in claim 1, wherein said securing element comprises a screw securely mounted in said opening and said recess opening, said screw having a manually graspable and actuatable head forming said part thereof which protrudes from said recess opening.

3. The motor-driven hand tool held by a user as defined in claim 1, wherein said removable grip is formed as an ergonomically shaped pommel, and said recess opening of said removable grip is embodied as an opening extending through said removable grip.

4. The motor-driven hand tool held by a user as defined in claim 3, wherein said recess opening has two opposed sides opening in said outside surface, and wherein said part thereof of said securing element extends from said two opposed sides of said recess opening of said removable grip past the outside surface of said removable grip.

5. The motor-driven hand tool held by a user as defined in claim 1, wherein the mounting position of said removable grip on said motor-driven hand tool is predetermined.

6. The motor-driven hand tool held by a user as defined in claim 5, wherein the portion of said removable grip that engages said motor-driven hand tool is shaped to be complimentary to the shape of said portion of said motor-driven hand tool that said portion of said removable grip engages.

7. The motor-driven hand tool held by a user as defined in claim 5, further comprising ribs mounted to said removable grip, wherein said removable grip and said motor-driven hand tool are centered relative to each other by said ribs.

8. The motor-driven hand tool held by a user as defined in claim 1, wherein said removable grip includes two half-shell parts.

9. The motor-driven hand tool as defined in claim 8, wherein said half-shell parts are interlocked.

10. The motor-driven hand tool held by a user as defined in claim 8, wherein said half-shell parts define said opening which receives a part of said securing element and secures said securing element to said half-shell parts when said half-shell parts are connected.

11. The motor-driven hand tool held by a user as defined in claim 1, wherein said securing element defines an engagement point for use in adjusting the portion of said securing element relative to said removable grip.

12. The motor-driven hand tool held by a user as defined in claim 11, wherein said removable grip defines an access opening through which said securing element is engaged for tightening and loosening said securing element to said motor-driven hand tool.

13. The motor-driven hand tool held by a user as defined in claim 12, wherein said removable grip is formed as an ergonomically shaped pommel, and said recess opening is embodied as an opening extending through said removable grip, and wherein said access opening intersects said recess opening.

14. A removable grip having a securing element mounted therein, for a motor-driven hand tool held by a user, said removable grip defining an outside surface, a front contacting surface, an opposed rear end surface, an opening and a recess opening, which recess opening is oriented transversely to an intersecting said opening, and opens into said outside surface adjacent to said front contacting surface, in which opening and recess opening said securing element is mounted, said securing element having a housing engaging portion protruding outwardly from said front contacting surface and a part thereof, said outside surface to be manually rotatable relative to said removable grip by a direct engagement of said part thereof with the user's hand protruding from said recess opening past, thereby mounting and releasing said removable grip from the motor-driven hand tool.

15. The removable grip as defined in claim 14, wherein said securing element comprises a screw securely mounted in said opening, said screw having a manually graspable and actuatable head forming said part thereof which protrudes from said recess opening.

16. The removable grip as defined in claim 14, wherein said removable grip is formed as an ergonomically shaped pommel, and said recess opening is embodied as an opening extending through said removable grip.

* * * * *